US005577916A

United States Patent [19]

Gordon

[11] Patent Number: 5,577,916

[45] Date of Patent: Nov. 26, 1996

[54] GOLF SWING WEIGHT SHIFT WINDOW TRAINING APPARATUS AND METHOD

[76] Inventor: John D. Gordon, 42 Gold Star Rd., Cambridge, Mass. 02140

[21] Appl. No.: 385,855

[22] Filed: Feb. 9, 1995

[51] Int. Cl.[6] ..... A63B 69/36

[52] U.S. Cl. ..... 434/252; 473/268

[58] Field of Search ..... 434/252, 247; 473/266, 268

[56] References Cited

U.S. PATENT DOCUMENTS

| | | | |
|---|---|---|---|
| 2,669,782 | 2/1954 | Turner | 473/268 |
| 3,656,752 | 4/1972 | Moriarty | 473/268 |
| 3,826,502 | 7/1974 | Sorge . | |
| 4,022,475 | 5/1977 | Todd . | |
| 4,765,624 | 8/1988 | Sprague | 473/268 |
| 4,796,892 | 1/1989 | Doerrfeld | 473/268 |
| 4,896,375 | 1/1990 | Colucci . | |
| 5,177,510 | 1/1993 | Peters et al. . | |
| 5,273,284 | 12/1993 | Montgomery . | |

FOREIGN PATENT DOCUMENTS 3055074A 3/1991 Japan .

OTHER PUBLICATIONS

Advertisement for Headfreezer in "Golf Digest" Magazine, Feb. 1995, published Jan. 1995.

*Primary Examiner*—Gene Mancene
*Assistant Examiner*—Jeffrey A. Smith

[57] ABSTRACT

Disclosed is a method and apparatus for improving consistency of a golfer's swing by affording visual feedback of head displacement and resultant body orientation. The training apparatus includes a scale member having calibrated indicia disposed thereon and a support structure including a base portion and cantilever member adapted to position the scale at a predetermined relative location along the golfer's line-of-sight when the golfer is in an initial address position. Head displacement during the backswing is visually apparent to the golfer as a shift in the position of the object ball from the address position. By controlling the amount of shift and ensuring the ball has visually returned to a desired point at or near the address position at the moment of impact, the golfer may be assured of proper body orientation and weight distribution at impact resulting in improved swing consistency.

13 Claims, 2 Drawing Sheets

GOLF SWING WEIGHT SHIFT WINDOW TRAINING APPARATUS AND METHOD

TECHNICAL FIELD

The present invention relates generally to golfing and more specifically to a method and apparatus for improving a golfer's performance by providing visual indication of weight shift movement during a club swing.

BACKGROUND INFORMATION

Golfing provides countless hours of exercise and enjoyment to diverse individuals the world over; however, this source of entertainment and competition may be quite frustrating to an individual golfer who fails to hit golf balls in a consistent, controlled manner. Part of the difficulty in hitting a golf ball consistently results from the complex movements required of the golfer to bring a golf club head into contact with the ball with desired force and direction.

In conventional practice, before swinging the club to strike the ball, a golfer addresses the ball by standing comfortably with weight substantially evenly distributed on both feet and with the golf club head proximate the ball. During the golf swing, the line-of-sight of the golfer remains fixed on the ball. The club head is smoothly retracted a predetermined distance as weight is shifted to the back foot, advantageously achieving a maximum weight shift at or near the top of the backswing. As the club is swung forward, substantially tracing the contour of the backswing, weight is returned to the front foot so that at the moment of impact, body position is substantially similar to that of the address position. After impact, weight is further shifted to the front foot and the club follows through, continuing in a generally arcuate path over the golfer's shoulder. A primary mechanism for achieving proper weight shift is through controlled hip rotation.

Clearly, club selection and swing parameters, such as amount of retraction and club speed, are determined based on a variety of factors, including location and orientation of the ball relative to the pin, for example. One guideline, however, which remains generally applicable is that the position and orientation of the golfer's body at the time of impact should be substantially similar to that at the time the ball is initially addressed. Resuming the address position at impact is often quite challenging and generally becomes increasingly more difficult the greater the backswing, due to the complex coordinated motion required of the golfer's body.

There exist devices which are commercially available in the marketplace or are otherwise known which purport to improve a golfer's performance through control of the swing. Such devices range from costly systems including pressure sensitive pads, which quantify the amount of weight shift during a swing, to complex harnesses worn by or structures surrounding the golfer which constrain body and/or club motion. While such devices may afford some benefit to some golfers, these devices are generally costly, complex and may interfere with the natural motion of the body. Further, many such devices are restricted to practice settings, being altogether inapplicable or impractical for use on the golf course during play. Techniques and motions learned through the use of such devices may translate poorly to an unencumbered play setting, for example, due to an acquired reliance on physical restraints, however subtle.

SUMMARY OF THE INVENTION

A method and apparatus for improving a golfer's performance by providing calibrated motion feedback to the golfer during a swing is disclosed. The golf swing training apparatus includes a base portion adapted to be rested on or secured to the ground. An adjustable cantilever member extends from the base portion and supports, at the free end thereof, a scale member which typically might include calibrated numerical designations or indicia, and may be configured as an edge or a partially or wholly enclosed window.

In operation, the training apparatus is positioned on the ground and adjusted such that the object ball is aligned and centrally disposed in the window when the golfer is in the address position. As the golfer's weight shifts during the backswing, lateral movement of the golfer's head may be readily recognized by an apparent visual shift in the location of the ball relative to the window. By ensuring that the ball has visually returned to its initial address location immediately prior to impact, the golfer may be assured that head position and resultant body position substantially replicates that of the initial address position. A golfer who may want to lead with the hips on the downswing such that the head position during contact lags a precise amount behind the position of the head during address may accomplish this as well.

By providing visual feedback of head movement, the golfer may readily learn to adapt and coordinate body motion to achieve a repeatable, controlled swing for each club utilized. Further, the size and nature of the training apparatus affords the capability to employ the apparatus on the golf course during actual play, if desired. The cantilevered support arrangement of the scale member permits hitting the ball with the club without disturbing the apparatus.

The training apparatus may be manufactured from sheet stock of unitary construction or of pliable robber and is configured to be readily produced and stored in a collapsed condition, being easily transformed into an adjustable, dimensional state for use.

BRIEF DESCRIPTION OF DRAWINGS

The novel features believed characteristic of the invention are set forth and differentiated in the appended claims. The invention in accordance with preferred and exemplary embodiments, together with further advantages thereof, is more particularly described in the following detailed description taken in conjunction with the accompanying drawings in which:

MODE(S) FOR CARRYING OUT THE INVENTION

Figure 1:
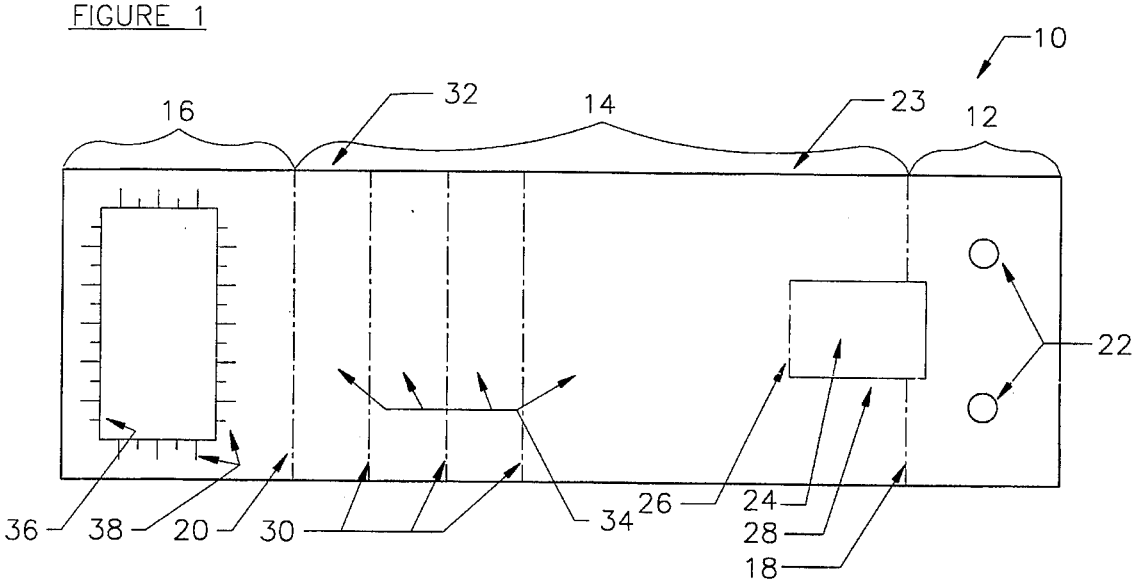
FIG. 1 is a schematic, plan view of the training apparatus in a planar state, in accordance with a preferred embodiment of the present invention.

Depicted in FIG. 1 is a schematic plan view of the training apparatus 10 in a collapsed, planar state, in accordance with a preferred embodiment of the present invention. The embodiment of the apparatus 10 shown here is adapted for simple, efficient manufacture from sheet stock, such as cardboard, rubber or polymer; however, as will become apparent, the invention is not limited to manufacture from a sheet stock good nor is the invention limited to manufacture of unitary construction.

Apparatus 10 is depicted here as generally rectangular in shape and includes a rectangular base portion 12, a rectangular cantilever member 14, and a rectangular scale member 16 arranged as shown in intimate, serial relation. Junction 18, disposed between base 12 and cantilever 14 and depicted here as a broken line, is a bend or preformed fold line, as is junction 20, disposed between cantilever 14 and scale 16. The relative sizes and shapes of base 12, cantilever 14 and scale 16 as shown here form a general use training apparatus 10 and one or more elements may be varied as desired to tailor the apparatus 10 to achieve a particular purpose. For example, if increased stability is desired, the size of the base 12 may be increased as well as the shape thereof changed to a square, triangle or other contour.

As depicted, base 12 includes two generally centrally disposed apertures 22 sized and configured to accept either a fastener or weighted member to afford stabilization of the apparatus 10 while in use, as will be discussed in greater detail hereinbelow with reference to FIG. 2. One or more apertures 22 may be included and located as desired. Alternately or additionally, the base 12 may be of sufficient size and weight to provide acceptable stability to the apparatus 10 without the need for fasteners or additional weighted members.

Proximal end 23 of cantilever 14 includes a generally centrally disposed, rectangular tab 24 pivotable from cantilever 14 along junction 26, a preformed fold line, tab 24 being cut from the stock forming the apparatus 10 along three contiguous edges shown generally in solid line at 28. Junction 26 is disposed remotely from junction 18 so that the tab 24 extends toward the base 12, the length being specified to afford a predetermined angular range of adjustment between the cantilever 14 and base 12, as discussed hereinbelow. In this embodiment, the tab 24 extends beyond junction 18; however, in alternate embodiments, the tab 24 may terminate at or before junction 18. Cantilever 14 further includes additional preformed fold lines or junctions 30 (three being shown) located generally at a distal end 32 thereof, dividing cantilever member 14 into a plurality of cantilever sections 34.

Lastly, scale 16 includes a centrally disposed viewing window aperture 36 of rectangular shape including calibrated, visually ascertainable indicia, shown generally at 38, disposed about a perimeter thereof. Indicia 38 may include singly or in combination lines of different length, alphanumeric characters and digits, or any other means for providing readily apparent visual differentiation, one to the next. Here, indicia 38 include differing length lines which are alternately disposed symmetrically along the entire perimeter of window 36; however, placement may be limited as desired, for example to a single edge or to two adjacent or opposed edges.

Figure 2:
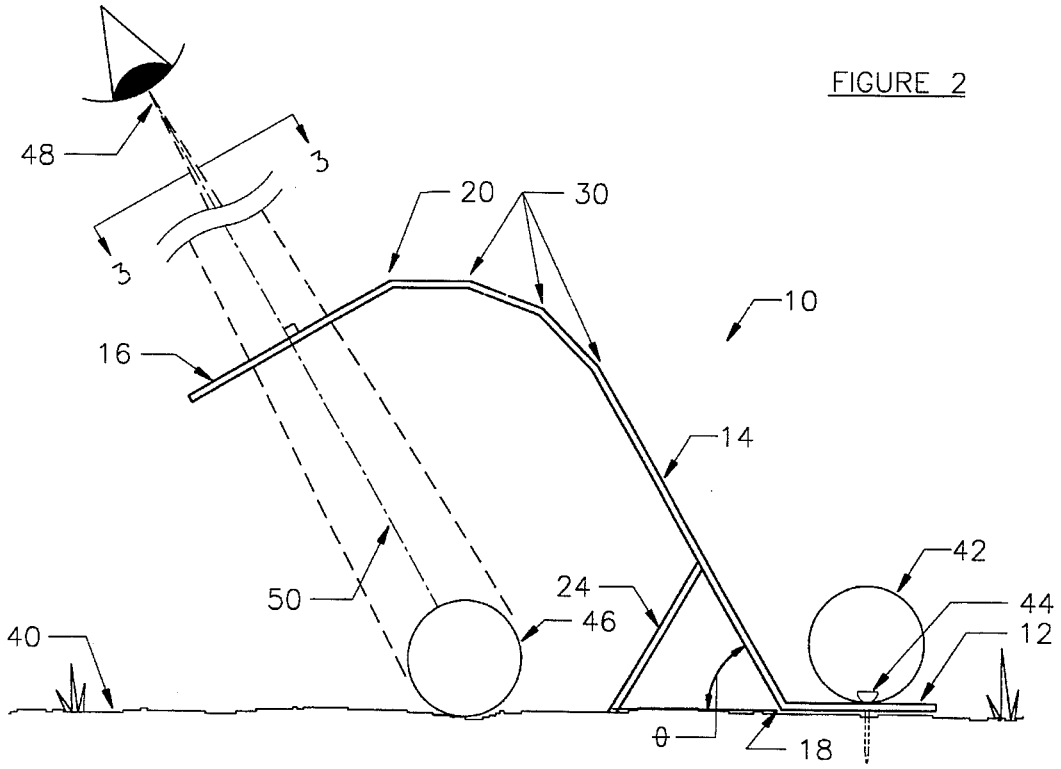
FIG. 2 is a schematic, side view of the training apparatus in use in a dimensional state, in accordance with an exemplary embodiment of the present invention.

FIG. 2 depicts a schematic, side view of the training apparatus 10 in use in a dimensional state, in accordance with an exemplary embodiment of the present invention. Base 12 is disposed in contact with the ground 40 and, for purposes of example, is stabilized by both methods discussed hereinabove, namely a weighted member 42 in the form of a golf ball and a fastener 44 in the form of a golf tee, each cooperating with respective apertures 22 shown in FIG. 1. Tab 24 is pivoted from the plane of the cantilever proximal end 23 to support the proximal end 23 at a desired angle θ relative to the ground, or alternately at the supplementary angle thereof relative to the base 12. Tab 24 may be sized and configured to provide for a range of adjustment of angle θ from about 30 degrees to about 90 degrees; however, values beyond this range may be desirable for a particular application and all such values are considered within the scope of the invention. The angular range of adjustment should be sufficient to accommodate all contemplated combinations of lie angles, club lengths and user heights.

Junctions 20, 30 provide independent angular adjustment capability to position the object golf ball 46 in a predetermined position relative to the scale member 16, as observed from viewpoint 48 along line-of-sight 50. The predetermined position contemplated and variations thereof are discussed below, beginning with reference to FIG. 3. Viewpoint 48 is coincident with the viewpoint of the user of the apparatus 10 when the user is initially addressing the object ball 46. Position of scale 16 is preferably adjusted to lie in a plane normal to the line-of-sight 50. Additionally, junctions 18, 20 and 30 are typically adjusted to provide generous clearance between the apparatus 10 and the object ball 46, as well as between the scale member 16 and the ground 40 so as not to interfere with hitting the ball 46 with a club (not depicted) travelling in a direction substantially normal to the plane of the figure at the moment of impact.

Figure 3:
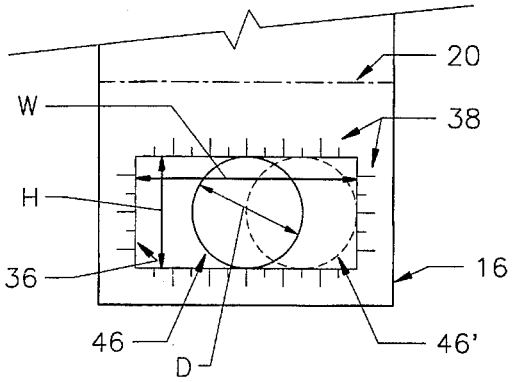
FIG. 3 is a schematic, partial plan view of the scale member taken along line 3—3 of FIG. 2, showing apparent visual shift of an object viewed therethrough in accordance with an exemplary embodiment of the present invention.

Referring now to FIG. 3, shown is a schematic, partial plan view taken along line 3—3 of FIG. 2 of the object ball 46 as seen through the window aperture 36 of scale member 16. In this example, the rectangular window 36 is sized and the apparatus 10 arranged such that the diameter D of the object ball 46 is substantially equal to the height H of window 36 when viewed therethrough while the user is in the address position. Given a standard, regulation size object golf ball 46, the value of window height H may be established to achieve desirable placement of the scale member 16 relative both to the object ball 46 and the viewpoint 48 of the user along the line-of-sight 50 of the user. Clearly, the greater the value of H, the closer the scale 16 must be to the object ball 46 for the ball 46 to visually fill the height H of the window 36. At increasing values of H approaching the diameter value D of the ball 46, the distance between the ball 46 and the scale 16 approaches zero. The smaller the value of H, the closer the scale 16 must be to the viewpoint 48 for the ball to visually fill the height H of the window 36.

The relative location of the scale member 16 along the line-of-sight 50 also effects the magnitude of the apparent visual shift of the object ball 46 within the window 36 in the transverse direction due to head motion or displacement in that direction. For example, in FIG. 3, the apparatus 10 has been adjusted properly such that the ball 46 is both centrally disposed in the window 36 and ball diameter D substantially matches window height H when the user is addressing the ball 46. As the user retracts the golf club (not depicted) during the backswing, any transverse displacement of the user's head is apparent as a visual shift in the position of the ball 46 relative to the window 36 and may be quantified by reference to the calibrated indicia 38. At maximum transverse displacement of the user's head, which typically occurs at or near the top of the backswing, the user may see ball position as represented in dash line and shown generally at 46'. Clearly, the closer the scale 16 is to the ball 46, the less the apparent visual shift of the ball 46 relative to the window 36 and indicia 38 thereof for a fixed transverse head displacement.

Geometrically, the magnitude of the apparent visual shift of the ball 46 is directly relatable to the ratio of the distance between the center of ball 46 and the scale 16 and the distance between the center of ball 46 and the viewpoint 48. For example, given an object ball 46 having a known diameter D, the value of window height H may be advantageously established at about 0.9D so that the scale member 16 will be disposed proximate the ball 46 at an axial location about 90% of the distance between the viewpoint 48 and the center of ball 46 along the line-of-sight 50. Since the ratio of the distance between the scale 16 and the center of ball 46 and the distance between the viewpoint 48 and the center of ball 46 is equal to about 1:10, the ratio of apparent visual shift of the ball 46 to transverse head displacement, as measured by the indicia 38, is also equal to about 1:10. A maximum observed apparent visual shift of the ball 46 of, for example, about 0.4 inches therefore correlates with an actual transverse head displacement of about four inches. In this example, the indicia 38 could be preferably arranged in 0.1 inch increments.

In an exemplary embodiment, for an object ball 46 having a diameter D, the window 36 may have a height H of between about 0.65D and about 1.00D and a width W of between about 1.5H and 2.5H; however, the teachings of the invention are equally applicable to greater and lesser values and all such values are considered within the scope of the invention. It should be noted that once a value for window height H is selected, the overall dimensions of the apparatus 10 and portions thereof may be selected to ensure that the range of adjustment of the apparatus 10 is sufficient to position the scale 16 at the proper axial location along the line-of-sight 50 according to the geometric relationship discussed hereinabove. As stated, the range of adjustment should also accommodate all contemplated combinations of lie angles, club lengths and user heights. Further, the location, spacing and designation of indicia 38 may be selected to afford direct reading by the user of the magnitude of head displacement in inches, centimeters or other useful measure, as desired.

Accordingly, a user may use visual feedback information provided by the apparatus 10 to both limit the maximum amount of lateral head displacement at the top of the backswing as well as ensure that head displacement is at or near zero at the moment of impact of the ball 46 with the club head, or at some predetermined point between the maximum amount and zero.

The embodiment of the scale member 16 depicted in FIG. 3 may be used to afford a user substantial additional useful information about head displacement during a swing. For example, not only is the magnitude of transverse head displacement quantifiable, but also the magnitude of head movement in a direction normal thereto. Such movement would be indicated by apparent visual shifting of the object ball 46 toward or away from junction 20, as the case may be, and may be quantified by the associated indicia 38. Also, axial movement of the head along the line-of-sight 50 will have the effect of visually enlarging or decreasing the apparent diameter of the object ball 46 relative to the window 36. Both of these effects may be monitored and minimized through increased awareness and control using the apparatus 10.

Figure 4A:
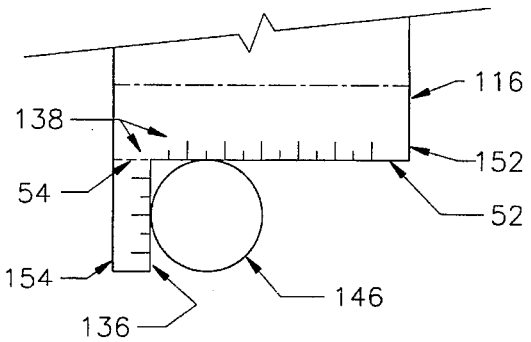
FIG. 4A is a schematic, plan view of an alternate embodiment scale member in accordance with the present invention.

While the embodiment of the scale member 16 depicted in FIG. 3, having a fully bounded and calibrated viewing window aperture 36, affords substantial information about spatial head displacement, numerous other embodiments are contemplated. For example, referring now to FIG. 4A, therein depicted is a schematic, plan view of an alternate embodiment scale member 116 in accordance with the present invention. Scale 116 is configured to provide a partially bounded viewing window aperture 136 including solely two contiguous, orthogonally disposed sides 152, 154 having indicia 138 disposed thereon. The scale 116 is shown here sized and configured for initial address registration with object ball 146 along both sides 152, 154 simultaneously. Clearly, a user could chose to initially align the ball 146 with a central portion of side 152 if desired. Alternately, scale 116 could be configured with side 154 extending from the right side instead of the left side as depicted in FIG. 4A. Such a configuration could be of beneficial use to a user having visual apparent displacement of the object ball 146 in a direction opposite that depicted in FIG. 3.

Alternately or additionally, respective lengths of sides 152, 154 may be increased or decreased as desired to provide, for example, for more readily apparent indications of transverse or normal head displacement during a swing. In a simplified configuration, side 154 may be eliminated altogether, for example, by cutting along the dotted line shown generally at 54. Scale 116 would then comprise solely a single side 152 having calibrated indicia 138 disposed along an edge 52 thereof. The magnitude of transverse head motion would still be quantifiable by reference to indicia 138; however, head motion in a direction normal thereto while apparent due to shifting of the object ball 146 toward or away from edge 52 would not be readily quantifiable. Such a configuration, however, has the advantage of providing additional room for club passage thereunder.

Figure 4B:
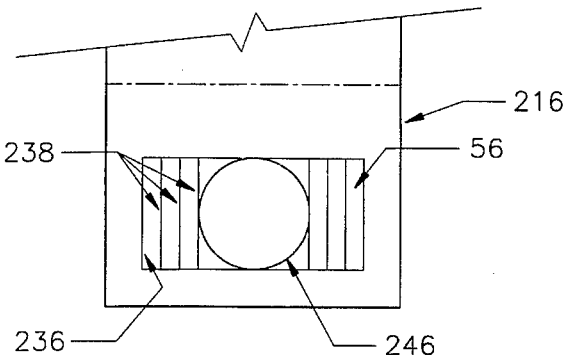
FIG. 4B is a schematic, plan view of another alternate embodiment scale member in accordance with the present invention.

The schematic plan view of another alternate embodiment scale member 216 in accordance with the present invention is depicted in FIG. 4B. Scale 216 includes a substantially transparent pane member 56 partially or wholly traversing window aperture 236. In the configuration depicted here, selected symmetrically disposed pairs of straight line indicia 238 extend across aperture 236 on pane 56 producing readily visually apparent demarcations helpful in accurately determining relative location of object ball 246. Three such line pairs are depicted here. Fewer or greater numbers of indicia 238 may be provided, singly or in pairs, as desired and may be disposed in a nonorthogonal relation relative to the edges of window 236 or to one another. Uniform and nonuniform grid arrangements of orthogonally intersecting indicia 238 are also contemplated. Alternately or additionally, indicia 238 may include one or more pairs of shaded or colored bands disposed on the pane 56, such a configuration facilitating rapid, accurate determination of apparent visual shift of object ball 246 during a golf swing. Such banding might be employed as an indication of acceptable, marginal and excessive transverse head motion ranges, for example, with different colors or shades being bounded by indicia 238.

Figure 4C:
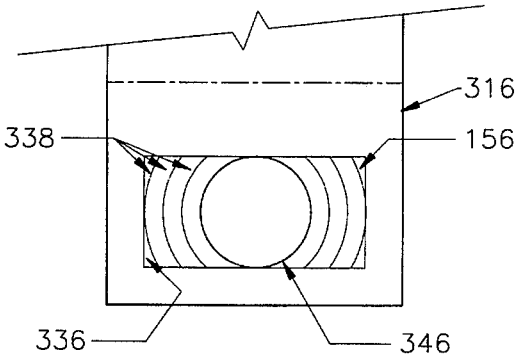
FIG. 4C is a schematic, plan view of yet another alternate embodiment scale member in accordance with the present invention.

Instead of straight line indicia 238, FIG. 4C depicts a schematic, plan view of yet another alternate embodiment scale member 316 in accordance with the present invention. Scale 316 includes transparent pane member 156 partially or wholly traversing window aperture 336. Disposed thereon are symmetrical pairs of contoured line indicia 338, shown here in a nesting arrangement generally circumscribing object ball 346. Scale 316 may include shaded or colored bands on pane 156 as discussed hereinabove. Further, with respect to the embodiment of either FIG. 4B or FIG. 4C, colored bands or shading, if included, could be selected to accentuate indications of apparent visual shift when an object ball 246, 346 of a specified color is employed, for example, by producing a visually discernible color change in the portion of the ball 246, 346 viewed therethrough.

Referring once again to FIGS. 1 and 2, another advantageous attribute of the apparatus 10 resulting directly from the mutually parallel orientation of junctions 18, 20 and 30 is that throughout the range of adjustment of the apparatus 10, the transverse orientation of the viewing window 36 remains substantially parallel with the ground 40. This attribute greatly facilitates erection and use of the apparatus while eliminating the need to adjust or correct for skewness. Embodiments of the invention are contemplated wherein the cantilever member is made narrower and the outer edge(s) of the viewing window is (are) rounded off to give a streamlined effect.

While there have been described herein what are considered to be preferred embodiments of the present invention, other modifications of the invention will be apparent to those skilled in the art from the teaching herein. For example, as discussed briefly hereinabove, the apparatus 10 may be readily manufactured from a sheet stock good of unitary construction. In addition to manufacture from cardboard, rubber or polymer, such materials as polyethylene foam and vinyl and metals including alloys of titanium, aluminum or other high strength to weight ratio materials may be employed. Further, since the apparatus 10 may be used outdoors for practice or play and be subject to environmental exposure, protective coatings of rubber or plastic, for example, may be desirable, especially for natural or synthetic fiber based materials. The body of the device may contain holes to facilitate usage outdoors in the wind.

Where compliant materials are utilized, at least to form the cantilever member 14, instead of providing a series of substantially planar cantilever sections 34 having discrete junctions 30 disposed therebetween, the cantilever itself may be uniformly or nonuniformly compliant to afford orientation thereof in a generally arcuate cross-sectional contour. Further, the apparatus 10 need not be able to fully collapse into planar form. Instead, the apparatus 10 may be discretely or infinitely adjustable between two erect, dimensional states. Yet further, the base portion 12 may include one or more integral fasteners or weights or could even be in the form of a spike member for direct insertion into the ground 40. Also, instead of being oriented away from the user, the base 12 could be oriented toward the user, being disposed at an acute angle relative to the cantilever 14 and may even provide a support for an object ball 46. Such a configuration affords advantageous use indoors in a practice setting, where the object ball 46 may be made of foam or other lightweight material, being conventionally referred to as a flat ball replica. The base 12 could even include a clamp member to provide support to the apparatus 10 by clamping on a suitable structure which may be stationary or movable relative to the ground 40. Additionally, a compliant element such as a gooseneck of suitable construction could be substituted for the planar cantilever member 14 to afford adjustable placement of the scale member 16. The gooseneck could be simply formed from a single, plastically deformable wire or wire rope or may comprise a more complex arrangement of cooperating, geometrically or frictionally engaged nested components with or without an additional locking feature.

It is therefore desired to be secured in the appended claims all such modifications as fall within the true spirit and scope of the invention. Accordingly, what is desired to be secured by Letters Patent of the United States is the invention as defined and differentiated in the following claims.

I claim:

1. A golf swing training apparatus for use in correlating visual shift of a golf ball disposed on a substantially planar surface, the apparatus comprising:

a unitary sheet of material, the unitary sheet comprising:

a base portion including means to stabilize the base portion on the substantially planar surface;

a cantilever member including at least one fold line, the at least one fold line dividing the cantilever member into a plurality of cantilever sections which are angularly adjustable relative to each other;

a scale member including a viewing aperture defined therein and visual indicia for use in correlating visual shift of the golf ball disposed between the scale member and the substantially planar surface as line-of-sight of a user shifts relative thereto; and a tab formed from cuts through the sheet for adjustably supporting the cantilever member within a predetermined angular range relative to the base portion;

wherein the base portion angularly adjustably adjoins the cantilever member at a fold junction between the base portion and the cantilever member, the cantilever member angularly adjustably adjoins the scale member at a fold junction between the cantilever member and the scale member, and the tab angularly adjustably adjoins a remainder of the sheet at a fold junction between the tab and the remainder of the sheet; and whereby the sheet may be converted from a collapsed, planar state in which the base portion, the cantilever member, the scale member, and the tab are substantially co-planar to a dimensional state for placement on the substantially planar surface in which the base portion is selectively angularly disposed relative to the cantilever member, and the tab is selectively angularly disposed relative to the base portion thereby forming support for the scale member above the substantially planar surface such that the golf ball positioned on the substantially planar surface may be viewed relative to the scale member.

2. The golf swing training apparatus according to claim 1 wherein:

the means to stabilize the base portion comprises at least one aperture, the at least one aperture each being sized and configured to receive a fastener at least partially therethrough.

3. The golf swing training apparatus according to claim 2 wherein:

the at least one aperture is each sized and configured to receive a golf tee at least partially therethrough as the fastener.

4. The golf swing training apparatus according to claim 1 wherein:

the means to stabilize the base portion comprises at least one aperture, the at least one aperture each being sized and configured to receive a weighted member at least partially therein.

5. The golf swing training apparatus according to claim 4 wherein:

the at least one aperture is each sized and configured to receive a golf ball at least partially therein as the weighted member.

6. The golf swing training apparatus according to claim 1 wherein:

the viewing aperture is at least partially bounded.

7. The golf swing training apparatus according to one of claims 1 or 6 wherein:

the visual indicia is disposed along at least one edge of the viewing aperture.

8. The golf swing training apparatus according to claim 1 wherein: the apparatus further comprises:

a substantially transparent pane member, the pane member at least partially traversing the viewing aperture and having the visual indicia disposed thereon.

9. The golf swing training apparatus according to claim 8 wherein the visual indicia comprises at least one straight line.

10. The golf swing training apparatus according to claim 8 wherein the visual indicia comprises at least one contoured line.

11. The golf swing training apparatus according to claim 8 wherein the visual indicia comprises at least one band.

12. The golf swing training apparatus according to claim 1 wherein:

the position of the scale member relative to the base member is infinitely angularly adjustable within a predetermined range of adjustment when in the dimensional state.

13. A method for correlating visual shift of a golf ball disposed between a scale member and a substantially planar surface as line-of-sight of a user shifts relative thereto in order to improve consistency of a golf swing, the method comprising the steps of:

providing the golf swing training apparatus, the apparatus comprising:

a unitary sheet of material, the unitary sheet comprising:

a base portion including means to stabilize the base portion on the substantially planar surface;

a cantilever member including at least one fold line, the at least one fold line dividing the cantilever member into a plurality of cantilever sections which are angularly adjustable relative to each other;

a scale member including a viewing aperture defined therein and visual indicia for use in correlating visual shift of the golf ball disposed between the scale member and the substantially planar surface as line-of-sight of a user shifts relative thereto; and a tab formed from cuts through the sheet for adjustably supporting the cantilever member within a predetermined angular range relative to the base portion;

wherein the base portion angularly adjustably adjoins the cantilever member at a fold junction between the base portion and the cantilever member, the cantilever member angularly adjustably adjoins the scale member at a fold junction between the cantilever member and the scale member, and the tab angularly adjustably adjoins a remainder of the sheet at a fold junction between the tab and the remainder of the sheet;

positioning the training apparatus, in a dimensional state, on the substantially planar surface such that the scale member is disposed along a line-of-sight between the user and the golf ball;

addressing the golf ball with a golf club;

visually aligning at least a portion of the golf ball with the scale member; and retracting the golf club from an address position; and impacting the golf ball with the golf club while ensuring a predetermined geometric relationship between the golf ball and the scale member at substantially the time of impact.

* * * * *